US012529482B2

(12) United States Patent
Cagni

(10) Patent No.: US 12,529,482 B2
(45) Date of Patent: Jan. 20, 2026

(54) DIFFUSION TERMINAL OF CLEAN AIR PROVIDED WITH DOUBLE EMISSION, AND CORRESPONDING AIR EXCHANGE SYSTEM

(71) Applicant: Andrea Cagni, Turin (IT)

(72) Inventor: Andrea Cagni, Turin (IT)

( * ) Notice: Subject to any disclaimer, the term of this patent is extended or adjusted under 35 U.S.C. 154(b) by 431 days.

(21) Appl. No.: 18/006,607

(22) PCT Filed: Jul. 21, 2021

(86) PCT No.: PCT/IB2021/056574

§ 371 (c)(1),
(2) Date: Jan. 24, 2023

(87) PCT Pub. No.: WO2022/023884

PCT Pub. Date: Feb. 3, 2022

(65) Prior Publication Data

US 2023/0272923 A1 Aug. 31, 2023

(30) Foreign Application Priority Data

Jul. 27, 2020 (IT) ..... 102020000018085

(51) Int. Cl.
*F24F 1/0011* (2019.01)

(52) U.S. Cl.
CPC ..... *F24F 1/0011* (2013.01)

(58) Field of Classification Search
CPC ..... F24F 13/062; F24F 13/078; F24F 1/0047; F24F 7/08; F24F 1/0011; A47C 21/044
See application file for complete search history.

(56) References Cited

U.S. PATENT DOCUMENTS 2,255,849 A * 9/1941 Kurth ..... F24F 13/062 454/294
5,133,693 A * 7/1992 Blomster ..... F24F 13/062 454/312

(Continued)

FOREIGN PATENT DOCUMENTS

DE 2833822 B1 9/1979
DE 10201711277 A1 12/2018

(Continued)

OTHER PUBLICATIONS

International Search Report and Written Opinion of International Application No. PCT/IB2021/056574, mailed on Sep. 24, 2021, 12 pages.

*Primary Examiner* — Ko-Wei Lin
(74) *Attorney, Agent, or Firm* — Heslin Rothenberg Farley and Mesiti P.C.; Victor A. Cardona, Esq.

(57) ABSTRACT

A diffusion terminal of clean air includes an outer body, which can be connected to a respective supply channel of clean air. The outer body has an outlet mouth for supplying clean air towards an inhalation area of a person. A first conical element is at least partially hollow arranged inside the outer body, so that an axis of the first conical element is substantially coincident with a main axis of the body. The first conical element has a base portion arranged close to a plane defined by the outlet mouth, so as to provide an outlet of an airflow along a crown defined between an inner surface of the outer body and an outer surface of the first conical element. The first conical element has at least one opening to enable passing of an airflow within the first conical element and through an outlet mouth thereof.

15 Claims, 11 Drawing Sheets

(56) References Cited

U.S. PATENT DOCUMENTS

| | | | | |
|---|---|---|---|---|
| 2011/0000566 | A1* | 1/2011 | Ruponen | F24F 1/01 138/38 |
| 2016/0334121 | A1 | 11/2016 | Oobayashi | |
| 2020/0333037 | A1* | 10/2020 | Perkinson | F24F 13/1426 |

FOREIGN PATENT DOCUMENTS

| | | | |
|---|---|---|---|
| FR | 2133215 | A1 | 11/1972 |
| JP | H0384356 | A | 4/1991 |
| JP | H0712846 | U | 3/1993 |
| JP | H0626701 | A | 2/1994 |
| JP | 2001317785 | A | 11/2001 |
| JP | 2006125728 | A | 5/2006 |
| JP | 4726404 | B2 | 7/2011 |
| JP | 2013076528 | A | 4/2013 |
| WO | 2013021720 | A1 | 2/2013 |

* cited by examiner

DIFFUSION TERMINAL OF CLEAN AIR PROVIDED WITH DOUBLE EMISSION, AND CORRESPONDING AIR EXCHANGE SYSTEM

CROSS REFERENCE TO RELATED APPLICATIONS

This application is a national stage filing under Section 371 of International Application No. PCT/IB2021/056574, filed Jul. 21, 2021, published in English on Feb. 3, 2022, as WO 2022/023884 and which claims priority from Italian Patent Application No. 102020000018085 filed on Jul. 27, 2020, the entire disclosures of which are incorporated herein by reference.

FIELD OF THE INVENTION AND PRIOR ART

The present invention falls within the field of controlled ventilation systems, which allow management of the air exchange of an environment with the outside.

More precisely, the invention relates to a terminal for diffusing a flow of clean air, designed to increase the quality of the air breathed in at one or more stations in a building, wherein a person may be stationed for any type of need. Purely by way of non-limiting example, the present invention is applicable to a workplace including one or more workstations, halls of restaurants, cinemas, shops, rooms of private homes or hotel structures, etc. The present invention is also applicable to any other type of inlet system, installed for example, in an external environment or on a means of transport.

The state of the art relating to the introduction of clean or primary airflows into the rooms is based on the concept of dilution of pollutants of metabolic or environmental origin. A certain flow of clean air is introduced through diffusers with large airflows, and characterized by a high degree of mixing of the clean air with the ambient air (in order to avoid disturbing airflows), and an equivalent part of stale ambient air is sucked in and expelled. Note that by virtue of the configuration indicated above, an average tolerable air quality is generally accepted, without guaranteeing that the persons inside the rooms breathe uncontaminated air, and with a degree of purity corresponding to that of the introduced air.

OBJECT AND SUMMARY OF THE INVENTION

The present invention has the object of proposing a diffusion terminal for a flow of clean air, which allows an increase in quality of the air breathed by a person stationed at a fixed station, ensuring a supply of clean air precisely at the area of inhalation, with minimal mixing with respect to the surrounding air, guaranteeing a very low content of pollutants and consequently a very high quality of the air breathed.

Another object of the invention is to provide a corresponding personal air exchange system comprising one or more diffusion terminals, which allows drastically reducing the flow of clean primary air generally introduced into the rooms of a building, and consequently reducing the energy consumption for treating and pumping the air itself.

Another objective is to achieve the aforesaid objects without the aid of elements that invade the area of inhalation, or that in any way limit the freedom of movement of the persons stationed at the stations.

Another object of the invention is to provide a personal air exchange system, comprising one or more diffusion terminals, which has a high flexibility of implementation, low installation costs and which is also particularly intuitive to use.

According to the present invention, these objects are achieved by one or more diffusion terminals, a personal air exchange system, and by a building incorporating the aforesaid system, having the characteristics forming the subject of claims 1, 9 and 15.

The claims form an integral part of the technical disclosure provided in relation to the invention.

More particularly, with a view to achieving one or more of the aforesaid objects, the invention relates to a terminal for diffusing clean air, designed to increase the quality of the air breathed by a person, said diffusion terminal comprising:

- an outer body, which can be connected to the outlet of a respective supply channel of clean air,
- said outer body having an outlet mouth provided for supplying clean air towards an inhalation area of a person,
- a first conical element that is at least partially hollow arranged inside the outer body, in such a way that the axis of the first conical element is substantially coincident with the main axis of the body,
- said first conical element having a base portion arranged close to a plane defined by the outlet mouth of the outer body, so as to provide the outlet of an airflow along a crown defined between an inner surface of the outer body and an outer surface of the first conical element,
- said first conical element comprises at least one opening to enable passing of an airflow within the first conical element and through an outlet mouth of the first conical element,
- in such a way that the clean air supplied by means of the diffusion terminal is realized with an airflow passing through said crown and another central airflow passing through the first conical element.

BRIEF DESCRIPTION OF THE DRAWINGS

The present invention will now be described in detail with reference to the attached drawings, given purely by way of non-limiting example, wherein.

DETAILED DESCRIPTION OF PREFERRED EMBODIMENTS

In the following description various specific details are illustrated aimed at a thorough understanding of examples of one or more embodiments.

The embodiments may be implemented without one or more of the specific details, or with other methods, components, materials, etc. In other cases, known structures, materials or operations are not shown or described in detail to avoid obscuring various aspects of the embodiments.

The reference to "an embodiment" in the context of this description indicates that a particular configuration, structure or characteristic described in relation to the embodiment is included in at least one embodiment. Therefore, phrases such as "in an embodiment", possibly present in different places of this description do not necessarily refer to the same embodiment. Moreover, particular conformations, structures or characteristics can be combined in a suitable manner in one or more embodiments and/or associated with the embodiments in a different way from that illustrated here, for example, a characteristic here exemplified in relation to a figure may be applied to one or more embodiments exemplified in a different figure.

The references illustrated here are only for convenience and do not therefore delimit the field of protection or the scope of the embodiments.

With reference to the figures listed above, reference 5 indicates a diffusion terminal for a flow of clean air, designed to increase the quality of the air breathed in at one or more stations P present in a building, wherein a person may be stationed for any type of need.

According to different embodiments, the invention is advantageously applicable to any type of building wherein there is an environment equipped with one or more stations P. Purely by way of non-limiting example, the present invention is applicable to a workplace including one or more workstations, meeting rooms, restaurants, cinemas, shops, rooms in private homes or hotel structures, etc. The invention is advantageously applicable, according to different embodiments, both to an environment wherein there is a single station P, and to a multi-station environment. The present invention is also applicable to any other type of intake system, installed, for example, in an external environment or on a means of transport.

Figure 1:
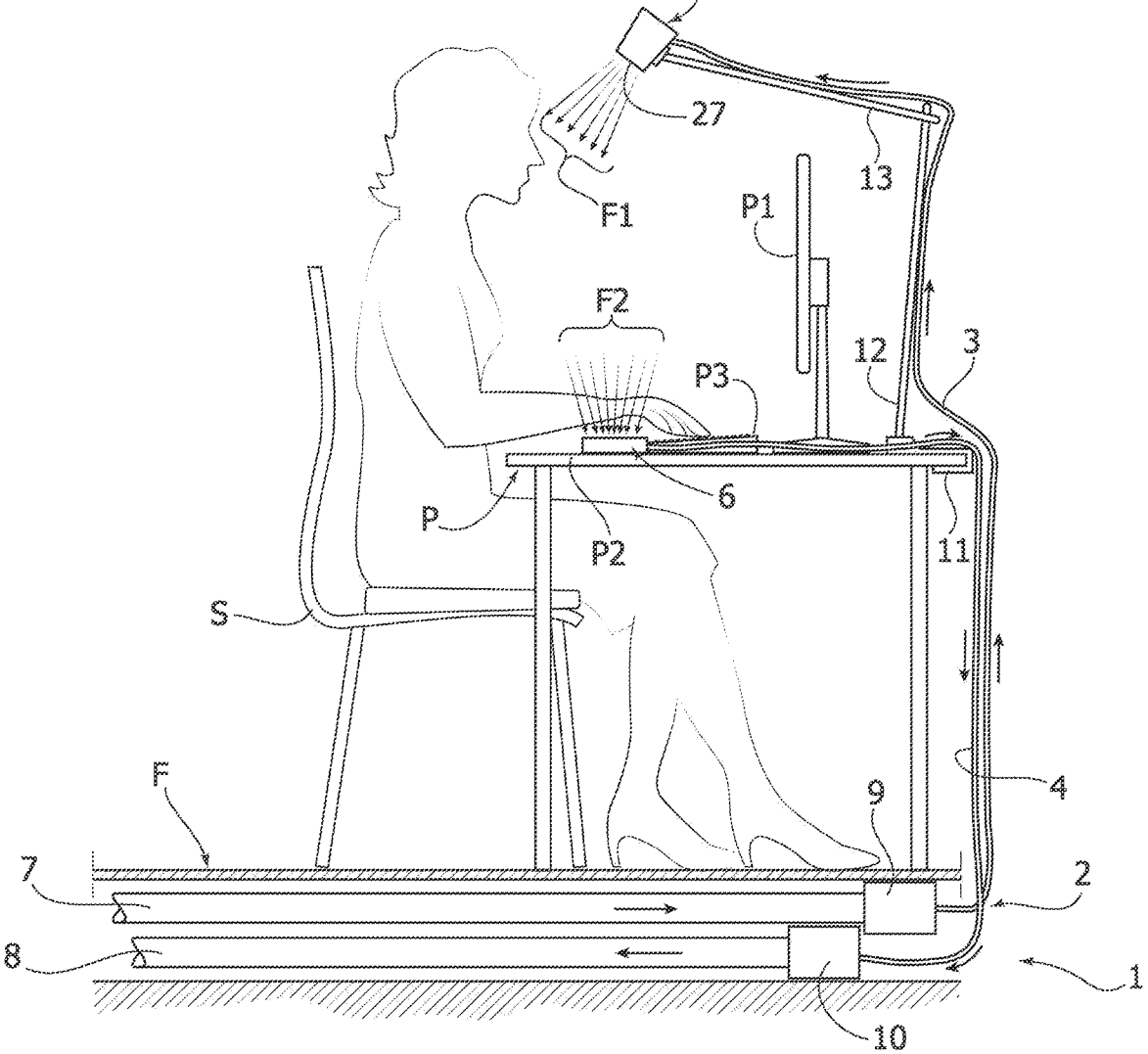
FIG. 1 is a schematic side view illustrating a station equipped with a personal air exchange system including a diffusion terminal according to the present invention.

In FIG. 1, reference 1 indicates—as a whole—an example of a personal air exchange system comprising at least one diffusion terminal 5 according to the invention. The diffusion terminal 5 comprises an outlet mouth 27 configured to introduce clean air in the direction of the inhalation area of a person who is stationed at a station P.

The system 1 may comprise a capillary distribution network 2 comprising at least one supply channel 3 of clean air, the outlet of which is connected to a respective diffusion terminal 5. The term "capillary distribution network" refers to a network of aeraulic ducts designed to reach all the stations P involved, so as to advantageously achieve the function of introducing a flow of clean air F1 in the vicinity of a person stationed at a station P.

In one or more embodiments, the supply channels 3 are micro-channels with a diameter varying between 10 and 50 mm.

In one or more embodiments, the supply channels 3 are flexible or rigid tubes.

The supply channels 3 and the diffusion terminals 5 may be arranged so that the diffusion terminals 5 are positioned, respectively, at a respective station P. Furthermore, embodiments of the system 1 may provide one or more diffusion terminals 5 for each station P.

According to a further characteristic of the system including one or more terminals 5, the personal air exchange system 1 also comprises a main supply network 7.

As illustrated in FIG. 1, the main supply network 7 may be spaced below a floating floor F. Of course, the main network 7 may also be spaced within a false ceiling structure or even in view, without thereby leaving the scope of the present invention. Again with reference to FIG. 1, the system 1 may comprise a first connecting plenum 9 interposed between the supply channels 3 and the main supply network 7.

As illustrated in FIG. 1, the station P may be a workstation equipped with any seating element S and a support surface P2, such as a desk, on which a monitor P1, a keyboard P3 of a computer, a laptop device P4, etc. may be arranged. Of course, the types of stations P illustrated in the drawings are provided purely by way of non-limiting example, as the system 1 may be associated with any type of station (for example, with a person standing, and without a support surface P2, or with a person resting in a bedroom).

In one or more embodiments, the diffusion terminal 5 is in a raised position above the support surface P2.

In one or more embodiments, the diffusion terminal 5 is installed in a ceiling or a wall, so that the outlet mouth 27 is flush with or protrudes from the ceiling or wall plane.

In one or more embodiments, as well as in the one illustrated in FIG. 1, the diffusion terminal 5 is supported by means of a support structure 12, designed to be fixed on the support surface P2 by means of hooking members 11 of any type (e.g. screws or clamps). In one or more embodiments, the support structure 12 is defined by at least one support arm, and comprises adjustable elements 13, arranged to adjust the position of the diffusion terminal 5 and, therefore, the direction of an intake airflow F1 emitted by the diffusion terminal 5. In accordance with what is illustrated in the drawings, the adjustable elements 13 are defined by an adjustable arm made like the arm of a table lamp. In the embodiment illustrated in FIG. 1, the supply channel 3 is spaced along and close to the structure 12, 13.

In one or more embodiments, the same support structure (for example, of tubular shape) also has the function of supply channel, so as to carry the air towards the diffusion terminal 5.

In the following part of the present description, the unique characteristics of the diffusion terminal 5 according to the present invention are now indicated.

As previously indicated, the system 1 comprises one or more diffusion terminals 5 connected, respectively, to the outlet of a respective supply channel 3. The diffusion terminals 5 are made to introduce a flow of clean air F1, preferably in the direction of the inhalation area of a person who is stationed in a station P with which the terminals 5 are, respectively, associated.

In one or more embodiments, the diffusion terminal 5 is defined by a vent with low flow rate and very low outlet speed, designed to introduce a laminar airflow—without turbulence—characterized by the greatest possible range in the absence of turbulence and, therefore, in the absence of mixing with respect to the more polluted surrounding air.

The vent may be placed at the end of an adjustable arm such as a table lamp. The terminal 5 may then be adjusted manually by acting on the adjustable arm, in order to vary the direction of the introduced airflow F1.

In accordance with what is illustrated in FIG. 1, the diffusion terminal 5 develops along a longitudinal axis substantially directed towards the inhalation area of the person stationed at a station P. The terminal 5 defines a blowing duct at the lower end of which there is an outlet mouth 27 for the outlet of the airflow F1.

Figure 8:
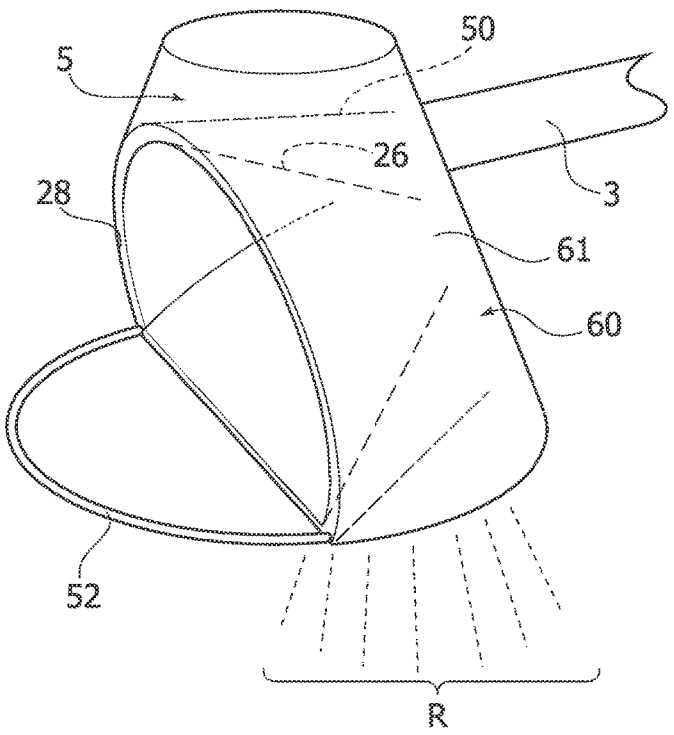

Other embodiments of the diffusion terminal 5 envisage the integration of the same in an oblique position with respect to the vertical axis of the geometric shape that contains the terminal 5 (FIG. 8).

Figure 2B:
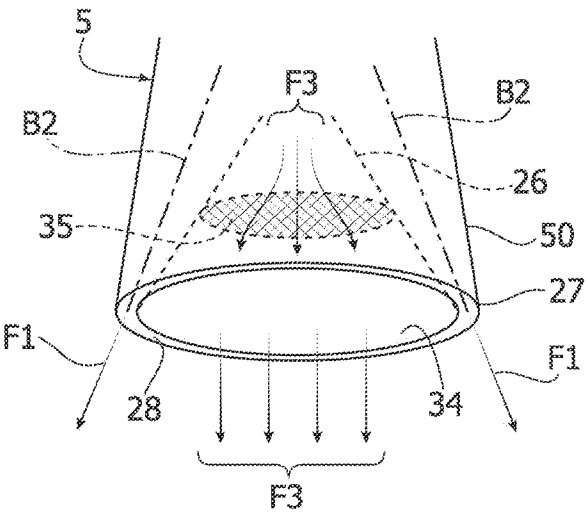
FIGS. 2A-2C are schematic perspective views illustrating different embodiments of a diffusion terminal according to the invention.
Figure 2C:
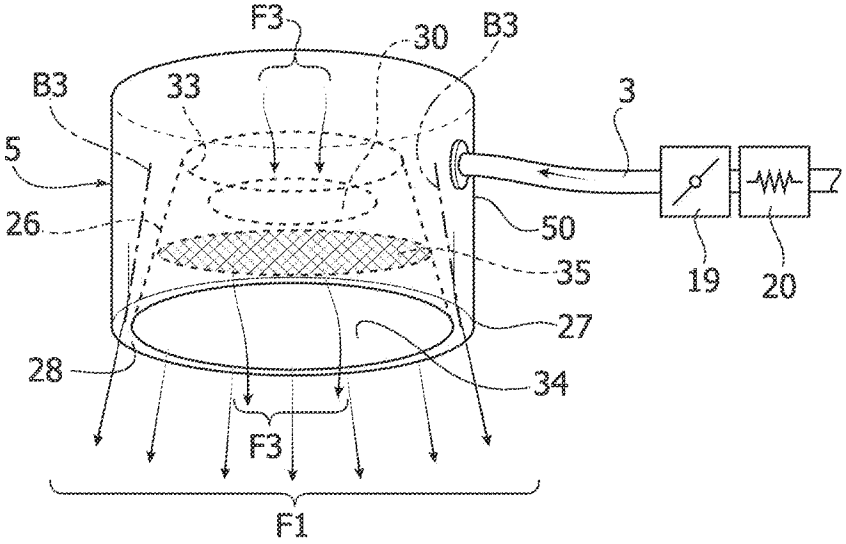

According to what is illustrated in the perspective view of FIG. 2C, the diffusion terminal 5 may be associated with one or more regulating devices 19, 20 to regulate the intensity and/or the temperature of the airflow F1 emitted from the diffusion terminal 5.

In one or more embodiments, the system 1 is configured to introduce, through the diffusion terminals 5, a flow of air F1 with a flow rate that is not constant, but suitably modulated, so as to simulate the effect of a natural breeze.

Figure 2A:
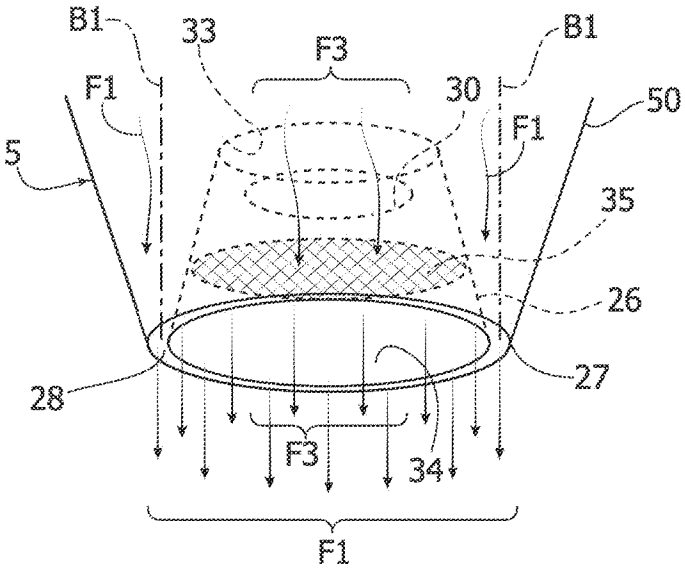

According to an important characteristic of the invention, as illustrated in FIGS. 2A-2C, the diffusion terminal 5 comprises an outer hollow body 50 within which a first conical element 26 is arranged.

The connection with one of the supply channels 3 is arranged at an upper portion of the outer body 50, so that the air can flow within the outer body 50, towards the outlet 27.

As illustrated in FIG. 2A, the outer body 50 may have a conical shape converging towards the outlet mouth 27.

The first conical element 26 is rigidly connected to the inner walls of the outer body 50, by means of any type of connection member (for example, a series of fins), so that the base portion of the conical element 26 is arranged in proximity to a plane defined by the outlet mouth 27 of the outer body 50, and the axis of the first conical element 26 substantially coincides with the main axis of the body 50.

The first conical element 26 is at least partially hollow and has a tapered shape in the opposite direction with respect to the tapered shape of the outer body 50. More specifically, with reference to an operative configuration, the outer body 50 has a tapered shape from top to bottom, at the end of which the outlet mouth 27 is formed, while the first conical element 26 has a shape tapered from the bottom upwards, away from the outlet mouth 27.

It will, therefore, be appreciated that by virtue of the structure indicated above, the airflow F1 introduced by the channel 3 and passing inside the body 50 is diffused along a substantially circular crown 28 defined between the inner wall of the outer body 50 and the outer wall of the first conical element 26.

Note that the air leaving the channel 3, before leaving the crown 28, passes through a cavity with a shape converging towards the crown 28, defined by the inner wall of the outer body 50 and by the outer wall of the first conical element 26.

According to another characteristic of the invention, the first conical element 26 has at least one opening to allow the passage of a flow of air F3 through said first conical element 26, up to an auxiliary mouth outlet 34 defined by a base portion of the first conical element 26. In the case of FIG. 2A, this opening is implemented with an upper opening 33 positioned at the upper end of the first conical element 26, perpendicular to the axis of the terminal 5.

As a consequence of this configuration and what was previously indicated in relation to the airflow F1, the introduction of clean air by means of the diffusion terminal 5 according to the invention takes place with an airflow F1 passing through the crown 28 indicated above, and by another central flow F3 passing through the first conical element 26.

Again with reference to FIG. 2A, the diffusion terminal 5 may comprise a deflector member 30, preferably disc-shaped, to adjust the flow rate of the airflow F3 passing inside the first conical element 26. The deflector member 30 may be advantageously arranged within the first conical element 26 so that the plane defined by the deflector member 30 is perpendicular to the axis of the diffusion terminal 5 and is in a convenient position for the aforesaid object.

Still with reference to FIG. 2A, the diffusion terminal 5 also comprises a separation element 35 with a micro-perforated or grid or filter surface, arranged within the first conical element 26, so as to introduce a central airflow F3 at a lower speed, but greater flow rate, of the flow F1 leaving the circular crown 28. The separation element 35 may be spaced parallel to the deflector member 30, and spaced apart from the latter, in the direction of the outlet mouth 34.

Thanks to the characteristics indicated above, it is possible to obtain a central jet F3 of clean air introduced with a piston effect, and kept conveniently separated and protected from the ambient air by the flow F1 leaving at a higher speed and lower flow rate from the crown 28.

Of course, other elements in place of the aforesaid deflector member 30 and separation element 35 may be arranged to direct the air that enters the outer body 50 from the channel 3, so as to cause the different flows F1 and F3 (for example, a series of openings provided on the surface of the first conical element 26).

It will, therefore, be appreciated that thanks to the characteristics indicated above, it is possible to reach the inhalation area of the individual with a flow of clean air—not mixed with the surrounding air, without the use of elements that invade this area or that limit freedom of movement in any way, or that hinder normal activities, or requires breathing through or very close to an air delivery device. This objective is achieved through the invention that comprises a particular type of diffuser 5 with laminar motion, very low flow rate, high stability and low mixing, through which the clean air reaches the inhalation area, despite the diffuser being at a certain distance from this area, in a position that does not in any way limit the normal use of the spaces of the stations P. This configuration of the diffusion terminal 5 with different flows F1 and F3 allows obtainment of a "deep throw" diffuser, or rather, a launch characterized by a predominantly laminar motion, and with very low mixing of the emitted air with respect to the ambient air, and which maintains these characteristics for a considerable distance. Furthermore, before leaving the crown 28, it should be noted that the air passes through a cavity with a shape converging towards the crown 28, defined by the inner wall of the outer body 50 and by the outer wall of the first conical element 26.

FIGS. 2B, 2C illustrate additional embodiments of the aforesaid diffusion terminal 5 having the same advantageous characteristics indicated above, with the difference that the outer body 50 has a respectively conical shape diverging towards the outlet mouth (FIG. 2B) and which is cylindrical (FIG. 2C).

In this case as well, it should be noted that the air, before leaving the crown 28, passes through a cavity with a shape converging towards the crown 28, defined by the inner wall of the outer body 50 and by the outer wall of the first conical element 26.

In accordance with what is illustrated in FIGS. 2A-2C, note how the angle defined between the wall of the outer body 50 and the wall of the first conical element 26 influences the direction of introduction of the airflow F1. More specifically, in the case of FIG. 2A, the bisectors B1 of the aforesaid angle determine the direction of the outlet flow F1 along the crown 28, so as to obtain an inlet flow area of cylindrical shape. In the case of FIG. 2B, the bisectors B2 of the aforesaid angle determine the direction of the outlet flow F1 along the crown 28, so as to obtain an inlet flow area of divergent conical shape. In the case of FIG. 2C, the bisectors B3 of the aforesaid angle determine the direction of the outlet flow F1 along the crown 28, so as to obtain an inlet flow area of divergent conical shape, with a smaller inclination than in the case of FIG. 2B.

Figure 3A:
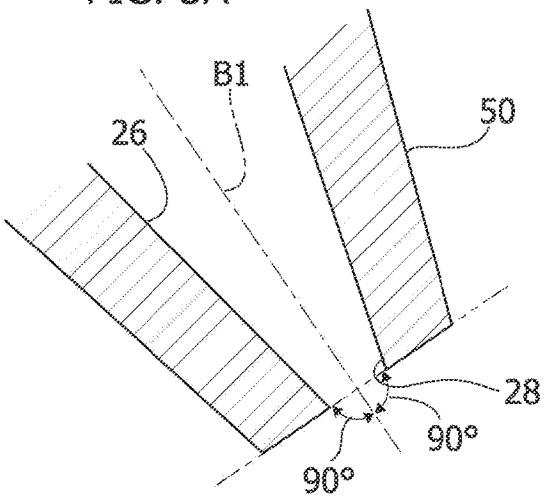
FIGS. 3A-3D are schematic views on an enlarged scale that illustrate different embodiments of some details of FIG. 2A, FIGS. 4A-4B are exploded perspective views that illustrate respective concrete embodiments of a diffusion terminal according to the invention.

FIGS. 3A-3D are cross-sectional views on an enlarged scale, which illustrate different configurations of the crown 28 of emission of the airflow F1. The crown 28 for emitting the outer laminar airflow is made in order to obtain a higher speed flow, with a deep throw, but characterized by minimal turbulence. To obtain this effect, the emission mouth 28 has a cross-section in which the thickness of the material constituting the two elements (first conical element 26 and outer body 50) is cut orthogonally to the bisector of the angle formed between the outer surface of the first conical element 26 and the inner surface of the outer body 50 (FIG. 3A).

Figure 3B:
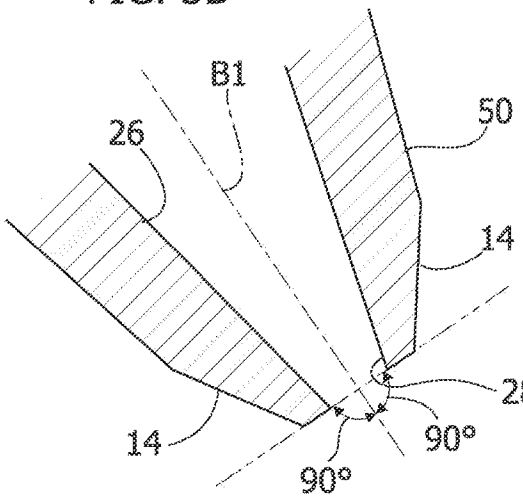
Figure 3C:
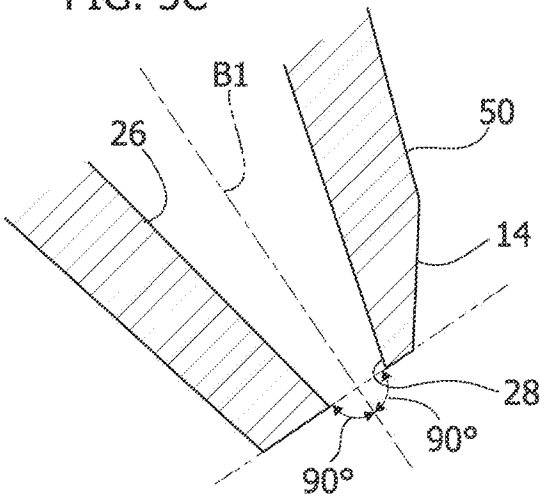
Figure 3D:
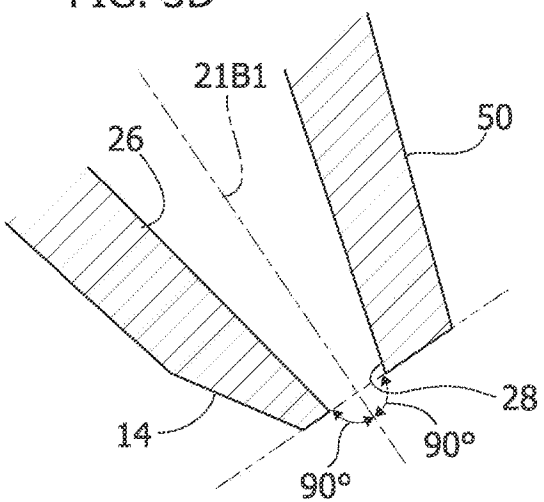

In one or more embodiments, with the object of thinning the thickness of the material at the outlet mouth 28 and further limiting the turbulence deriving from the edge effects, a taper 14 is applied which reduces the thickness of the end surface until eventually canceling it, to finish with a sharp edge. The taper 14 may be indifferently applied to the first conical element 26 (FIG. 3D) or to the outer body 50 (FIG. 3C) or to both (FIG. 3B).

Figures 4A, 4B:
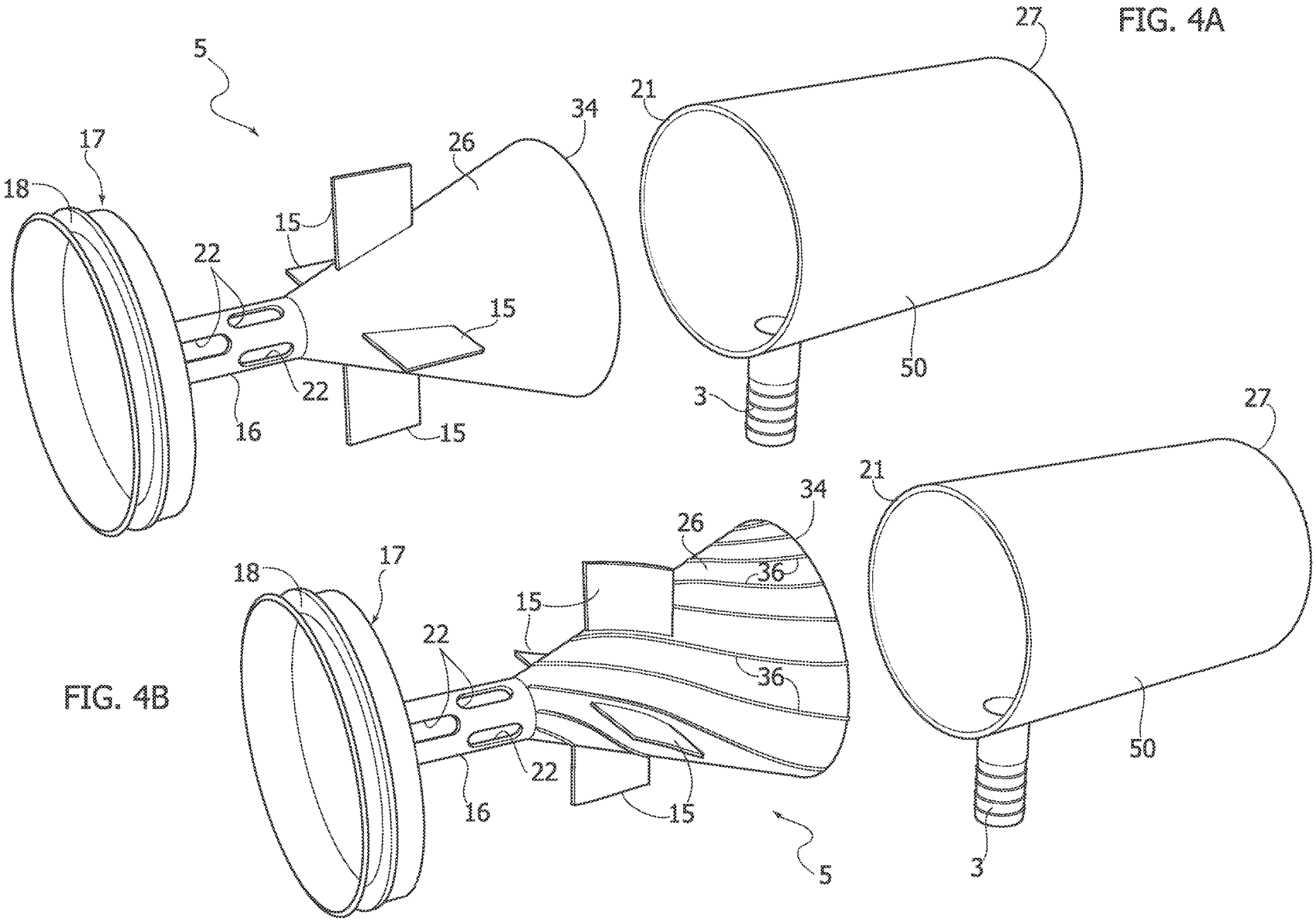

FIG. 4A is an exploded perspective view illustrating a concrete embodiment of a diffusion terminal 5 according to the present invention.

The reference 15 indicates a plurality of fins protruding radially from an upper portion of the first conical element 26, arranged for connection to the inner surface of the outer body 50. The first conical element 26 also includes a hollow cylindrical portion 16, spaced away from the cone portion of the first conical element 26, and having a diameter corresponding to that of the upper end of the cone portion. This cylindrical portion 16 may be equipped with a plurality of openings 22 (for example, holes or slots), to allow the passage of the air leaving the channel 3, inside the first conical element 26, and thus create the emission of the aforesaid central flow F3. Again with reference to FIG. 4, at the upper end of the aforesaid cylindrical portion 16 there is a closing member 17 configured to close the upper end 21 of the outer body 50 (in the case of the cylindrical figure). Of course, the closing member 17 has a diameter suitable for closing the upper end 21 of the outer body 50. Preferably, the connecting member 17 includes a protruding annular rim 18, configured to be adjacent to an upper terminal edge 21 of the outer body 50. The cone-shaped portion of the first conical element 26, the cylindrical portion 16 and the closing member 17 may be advantageously made in a single piece.

Figure 5:
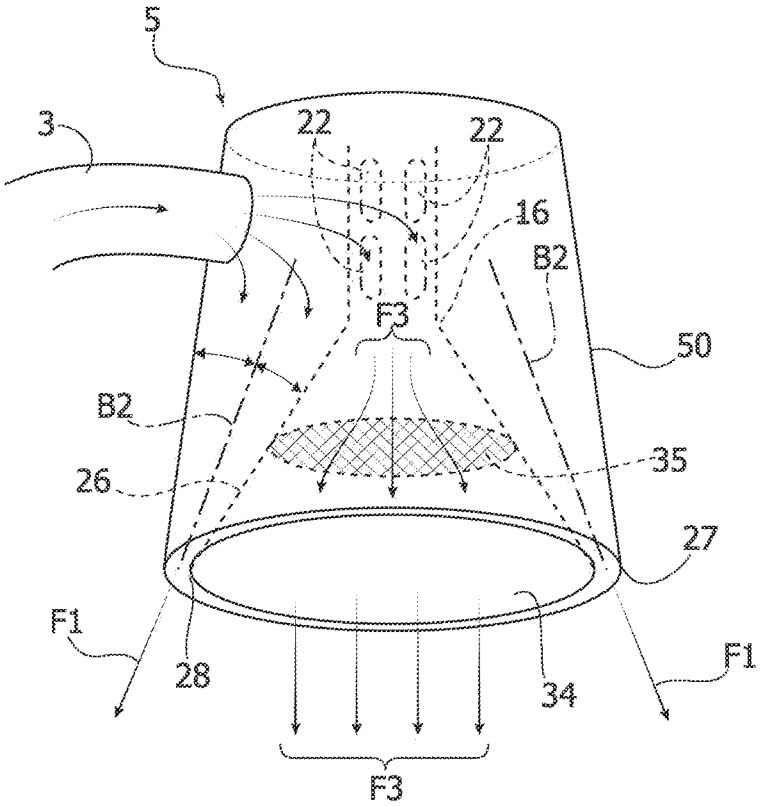
FIG. 5 is a schematic perspective view illustrating another embodiment of a diffusion terminal according to the invention.

In one or more embodiments, as well as in the one illustrated in FIG. 4B, the outer surface of the first conical element 26 is equipped with a plurality of raised elements 36 shaped as a series of striations or fins or ribs with the shape of a helical thread. This characteristic allows conferring a cylindrical or hollow conical shape to the airflow F1 emitted by the crown 28, (more generally a tubular shape), with a rotational motion around the axis of the cone, which increases the barrier effect of the flow F1 for protecting the central flow F3. In accordance with what is illustrated in FIG. 4B, the aforesaid fins 15 are aligned with the raised elements 36. FIG. 5 is a schematic perspective view illustrating an embodiment entirely similar to that of the previous Figure. Similarly to what has been described above, the first conical element 26 comprises the aforesaid cylindrical portion 16. Reference 22 indicates a plurality of openings—slots—22 to allow the passage of air, leaving the channel 3, inside the first conical element 26 and thus create the emission of the aforesaid central flow F3.

In order to indicate an operating condition of the diffusion terminal 5, in one or more embodiments, the diffusion terminal 5 comprises one or more integrated indicators.

Figure 6A:
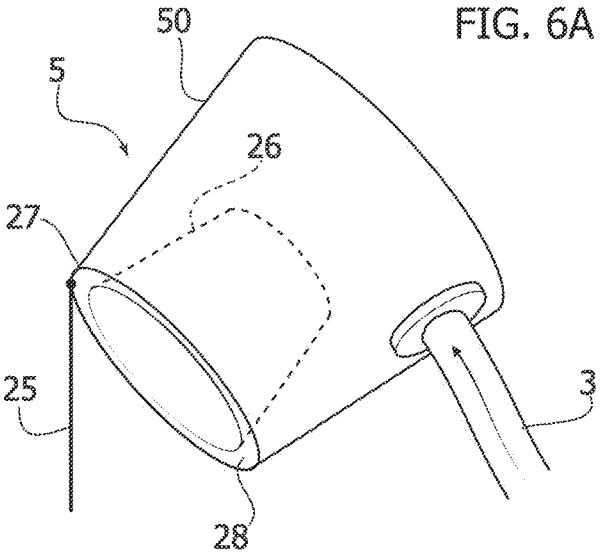
FIGS. 6A-13 are schematic perspective views illustrating additional characteristics of the diffusion terminal according to the invention.
Figure 6B:
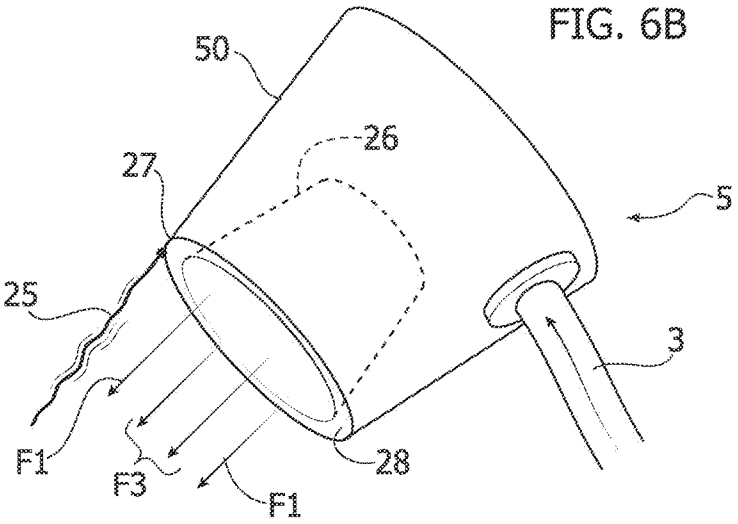

In accordance with what is illustrated in FIGS. 6A, 6B, this indicator is a fabric thread 25—of the wind vane type—arranged close to the outlet mouth 27 of the terminal 5. The thread 25 has an end joined to the terminal 5 and a free end. In this way, following the emission of the airflow, the thread moves from its rest configuration, in order to signal the emission of the airflow to a person (FIG. 6B).

In one or more embodiments, the diffusion terminal 5 has at least one transparent portion, to allow the display of further indicators to indicate an operating condition of the system 1, in particular, to signal the emission of the airflow and the correct flow rate, following an adjustment made by a user.

In particular, the body 50 of the terminal 5 may have a transparent area with a plurality of indicators in suspension, with the object of showing the presence of the airflow to a user.

In one or more embodiments, the diffusion terminal 5 incorporates a flexible tab that can be moved by the airflow introduced by the supply channel 3 into the body of the diffusion terminal 5. Thanks to the provision of a transparent portion of the diffusion terminal 5, a user can check the movement of the flexible tab as a result of the thrust made by the airflow introduced by the supply channel, in order to confirm the presence of the airflow.

In one or more embodiments, the diffusion terminal may comprise at least one LED device, which is lit in the presence of the airflow, so as to confirm the presence of the airflow to the user.

In one or more embodiments, one or more supply channels 3 may have a transparent portion wherein an indicator element is arranged to indicate the correct airflow and the correct flow rate, following an adjustment made by a user.

As indicated above, the present invention is applicable to a workplace including one or more workstations, meeting rooms, restaurants, cinemas, shops, rooms of private homes or hotel structures, etc.

Figure 7:
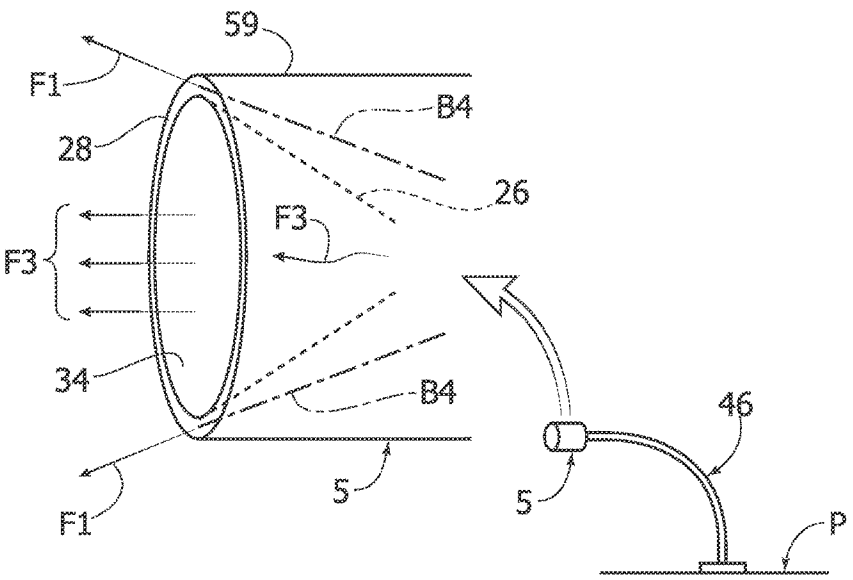

In one or more embodiments, as well as in the one illustrated in FIG. 7, the diffusion terminal 5 is defined by a microphone-shaped element 46, at the end of which the diffusion terminal 5 is arranged. In the specific case illustrated, the terminal comprises a first conical element 26 arranged within a cylindrical-shaped body 59. The bisectors B4 of the angles defined between the wall of the cylindrical body 59 and the wall of the first conical element 26 define the direction of introduction of the flow F1 through the crown 28. Of course, the shape of the microphone 46 illustrated in FIG. 7 is to be considered purely by way of non-limiting example.

As indicated previously, the diffusion terminals 5 are made, in the final installed configuration, to introduce a flow of clean air F1, preferably in the direction of the inhalation area of a person who is stationed in a station P with which the terminals 5 are, respectively, associated.

In one or more embodiments, the diffusion terminal 5 may comprise a motorized ball joint that enables an automatic movement to be made of a lower part of the terminal 5 with respect to an upper part connected to a supply channel 3. The terminal 5 may also comprise a sensor device configured to detect and track the eyes of a person, and consequently send a command signal, so as to create an automatic pointing of the terminal 5 towards the person's inhalation area.

According to another preferred characteristic of the invention, the diffusion terminal 5 is arranged to also perform a lighting function, since it incorporates one or more lighting devices.

In one or more embodiments, the lighting device is incorporated within a conical body, so as to diffuse rays of light R (for example, direct or diffuse, point-like or circular crown-form).

In one or more embodiments, the diffusion terminal 5 is enclosed within a lampshade that can be positioned above the head of an individual who is stationed at a station P.

In one or more embodiments, as well as in the one illustrated in FIG. 8, the diffusion terminal 5 is incorporated in a lamp 60 having a conical-shaped lampshade body 61. The lampshade body 61 has an inclined opening defining the outlet mouth of the terminal 5. Again with reference to FIG. 8, the aforesaid outer conical body 50 is incorporated within the lampshade body 61, which receives airflow from the supply channel 3. Similarly to what has already been described above, a first conical element 26 may be arranged within the conical body 50, so as to create an airflow leaving the crown 28. Again with reference to FIG. 8, the lamp 60 may comprise a handle 52 designed to allow a person to move the lamp 60 and, therefore, to vary the direction of introduction of the airflow through the terminal 5. The handle 52 may be semicircular in shape and spaced along a portion of the perimeter defined by a base portion of the lampshade body 61.

As previously indicated, the intake terminal 6 may comprise a support base to be freely positionable on a support surface P2 of a station P.

Figure 9:
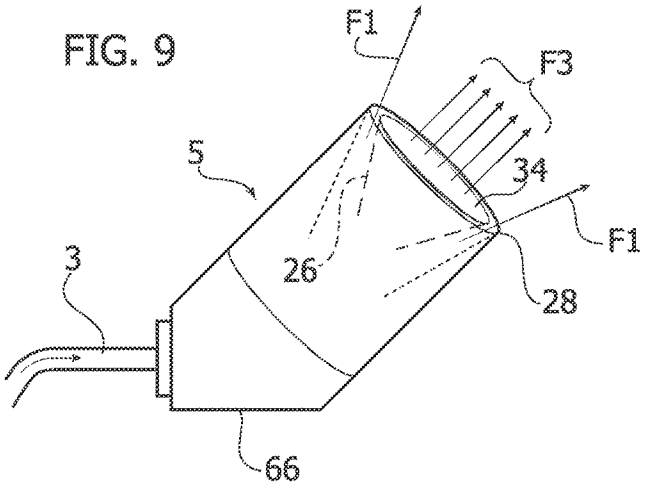

In one or more embodiments, as in the one illustrated in FIG. 9, the diffusion terminal 5 comprises a support base 66 so as to be able to be stably positioned on a support surface P2 of a station P. Close to the support base 66 the connection with a supply channel 3 is provided. Again with reference to what is illustrated in FIG. 9, the diffusion terminal 5 has a main axis extending in an oblique direction so that the outlet mouth 34 is oriented towards the inhalation area of a person who is stationed in a position P. As illustrated in FIG. 9, the diffusion terminal 5 with support base 66 comprises the aforesaid first conical element 26, so as to diffuse the aforesaid flows F1 and F3.

Figure 10:
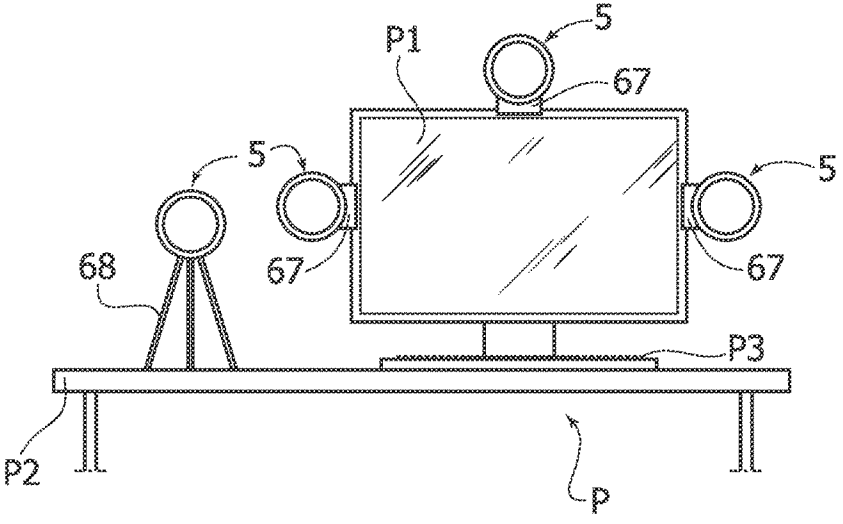

FIG. 10 illustrates a station P with a diffusion terminal 5 equipped with a tripod support base 68, so that the positioning of the terminal 5 can be varied according to the preferences and position of the person. Of course, the type of support base may widely vary with respect to what is illustrated.

Figure 11:
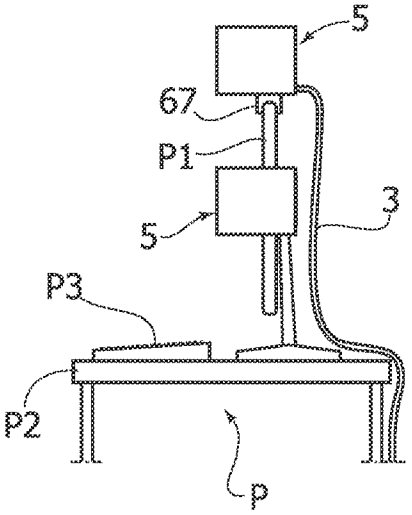

In one or more embodiments, as well as in the one illustrated in FIGS. 10, 11, a single station P may comprise a plurality of diffusion terminals 5.

The terminals 5 may comprise quick-coupling members 67, for stably coupling the terminals 5, for example, to a monitor P1 or to any other element of a station P. The head of the terminal 5 may be advantageously oriented according to per se known adjustment means.

It will, therefore, be appreciated that the diffusion terminals 5 are arranged to be positioned freely in one or more positions P according to the preferences and position of the person.

Figure 12:
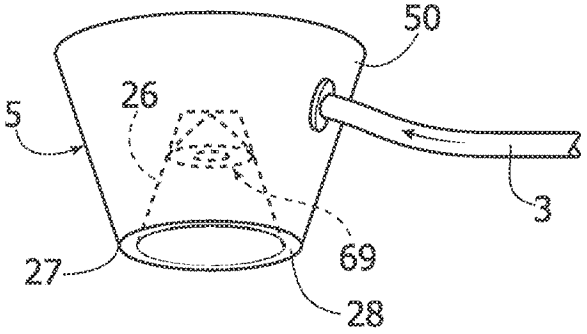

In one or more embodiments, as well as in the one illustrated in FIG. 12, one or more diffusion terminals 5 may be equipped with a respective integrated audio source 69.

Figure 13:
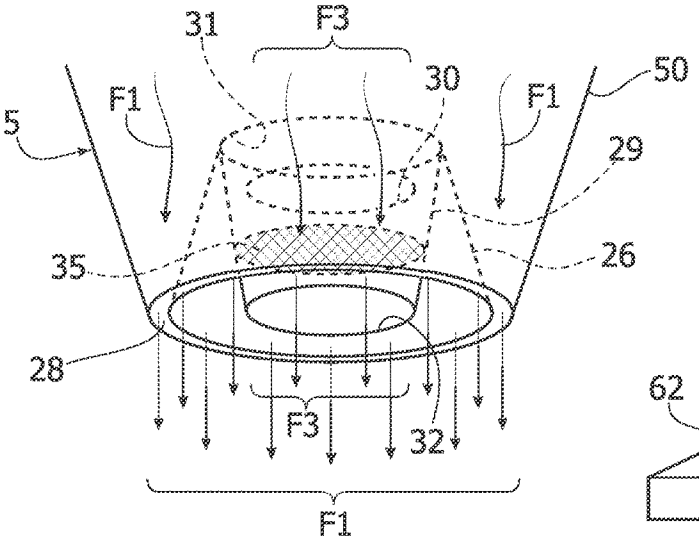

In one or more embodiments, such as the one illustrated in FIG. 13, the diffusion terminal 5 also comprises—in addition to the first conical element 26—a second conical element 29 arranged within the cavity defined by the aforesaid first conical element 26. Preferably, the second conical element 29 has a shape tapered from the bottom upwards, similarly to the outer body 50 illustrated. The second conical element 29 has an upper opening 31, coinciding with an upper opening of the first conical element 26, to allow the passage of a flow of air F3 from the outer body 50, through said second conical element 29, up to an auxiliary outlet mouth 32 defined by a base portion of the second conical element 29. As a consequence of this configuration, the introduction of clean air by means of the diffusion terminal 5 described above takes place with an airflow F1 passing through the crown 28 indicated above, and by another central flow F3 passing through the second conical element 29. Also in the case wherein the aforesaid second conical element 29 is provided, the aforesaid deflector member 30 and separation element 29 can be provided.

In light of the characteristics illustrated above of the multiple embodiments of the terminals 5, it should be noted that the shape and geometric dimensions of the diffusion terminals 5 may widely vary with respect to what is illustrated in the attached drawings. For example, the outer body 50 may be made with a significantly lower height than that illustrated in the figures. The diameter and shape may also vary from what is illustrated. Consequently, the conical elements 26, 29 may also be made with a height significantly lower than that illustrated in the drawings. Furthermore, as previously indicated, the inclinations of the walls of the conical elements 26, 29 can vary considerably with respect to what is illustrated in the figures, so as to create different directions of the airflows emitted by the terminals 5.

In accordance with another characteristic of the invention, the system 1 is designed to diffuse fragrances for short periods of time at random or programmed intervals, so that the user perceives the arrival of the flow of clean air. In one or more embodiments, the diffusion terminal 5, therefore, comprises a chamber for containing an essence, and a membrane, or other absorbent device, at least partially bathed in the essence itself. The outlet mouth 27 of the diffusion terminal 5 allows the perfume to be diffused into the environment through the membrane. The diffusion of the essence towards the environment may also be correlated to further openings arranged near the outlet mouth 27.

In one or more embodiments, the system 1 comprises additional elements that help the volatilization of the essence, such as, for example, electric resistors, small fans, or other devices requiring an external power supply, in order to correctly deliver the fragrance into the environment.

Alternatively, it is possible to provide a centralized fragrance diffusion system.

Further characteristics of the system 1 that can be associated with one or more diffusion terminals 5 will now be indicated in the following description.

As previously indicated, the system 1 comprises a capillary distribution network 2 having at least one supply channel 3 connected to a main supply network 7.

As illustrated in FIG. 1, the capillary distribution network 2 may comprise at least one return channel 4 of stale air connected to a respective intake terminal 6, designed to perform the function of capturing a flow of stale air F2 emitted during the exhalation phase by a person stationed at a station P. In the final installed condition, the intake terminals 6 may be positioned close to a respective diffusion terminal 5. The return channels 4 may be made in the same way as the supply channels 3.

According to another characteristic of the system 1 including one or more intake terminals 6, the personal air exchange system 1 also comprises a main return network 8 connected to return channels 4. Advantageously, the system 1 may comprise a second connecting plenum 10 interposed between the return channels 4 and the main return network 8.

It will, therefore, be appreciated that embodiments of the system 1 may provide both one or more diffusion terminals 5, and one or more intake terminals 6. In this case, in the final installed condition, it should therefore be noted that the supply and return channels 3, 4 are made to reach all the stations P involved, each station P being therefore equipped with at least one diffusion terminal 5 and at least one intake terminal 6.

In one or more embodiments, the system 1 may comprise an air handling unit operatively connected to the main supply network 7 and to the main return network 8. The air handling unit may be set up to perform a pumping and/or air intake and/or heat recovery and or heating and/or cooling and/or humidification and/or filtration and/or sanitizing and/or disinfection function, and/or perfuming of the air introduced through the diffusion terminals 5. The main supply network 7 may be connected to an external air intake, through the air handling unit, and the main return network 8 may communicate with the outside of the building, again through the air handling unit, wherein the system 1 is installed, aligned with at least one passage, so as to expel the stale air.

In one or more embodiments, the main supply network 7 may be connected to another air intake system either directly or by means of an additional interposed fan. The main return network 8 may be connected to another air extraction system either directly or by means of an additional interposed fan.

In one or more embodiments, the system 1 may comprise an air handling unit operatively connected to the main supply network 7, configured to perform a pumping and/or heating and/or cooling and/or humidification and/or filtration and/or sanitization and/or disinfection function, and/or perfuming of the air introduced through the diffusion terminals 5.

Thanks to the arrangement of the capillary distribution network 2, as described above, connected to the main supply and return networks 7,8, it is possible to achieve a series of advantageous effects.

In the first place, the system 1 can be installed by exploiting an aeraulic ducting network already present originally in a building wherein the system 1 is to be implemented. Secondly, it is possible to dispose of the aspirated air F2 outside the building, after any energy recovery. Furthermore, it is possible to improve coexistence in medium- or high-crowded environments as a result of a high reduction in the risk of contagion from viruses/bacteria, thanks to the fact that a supply of clean air is always guaranteed right in the inhalation area, and with minimal mixing with respect to the surrounding air, therefore, with a guarantee of high quality and very low pollutant content.

As previously indicated, the present invention is applicable to an environment wherein at least one station P is present wherein a person is stationed for any type of need.

In one or more embodiments, as well as in the one illustrated in the drawings, the intake terminal 6 can be fixed on the support surface P2 of a station P.

In one or more embodiments, the intake terminal 6 is fixed or freely positioned on the floor of a station P.

It will, therefore, be appreciated that by virtue of the configuration indicated above, the intake of a flow of stale air F2 is concentrated precisely at the exhalation area of a person who exhales through the nose during operation.

Some detailed characteristics of the intake terminal 6 will now be indicated in the following description.

As previously indicated, the intake terminals 6 are designed to draw in a large part of the flow of stale air F2 emitted in the exhalation phase by a person who is stationed at a station P. The intake is, therefore, concentrated precisely at the expulsion area of the air when exhaling through the nose.

In one or more embodiments, the intake terminal 6 is a device of the wrist rest type for a keyboard or a keyboard rest or a laptop device support, of variable dimensions depending on the support requirements of the overlying object. The intake terminal 6 is equipped with micro-holes or slits positioned on the upper or side face, and organized in such a way as to make the intake effective according to the context in which the system 1 is applied.

In one or more embodiments, one or more intake terminals 6 may be arranged between the keyboard P3 and the monitor P1 arranged on the support surface P2, so as to collect the emission of air by a person during speech.

Figure 14:
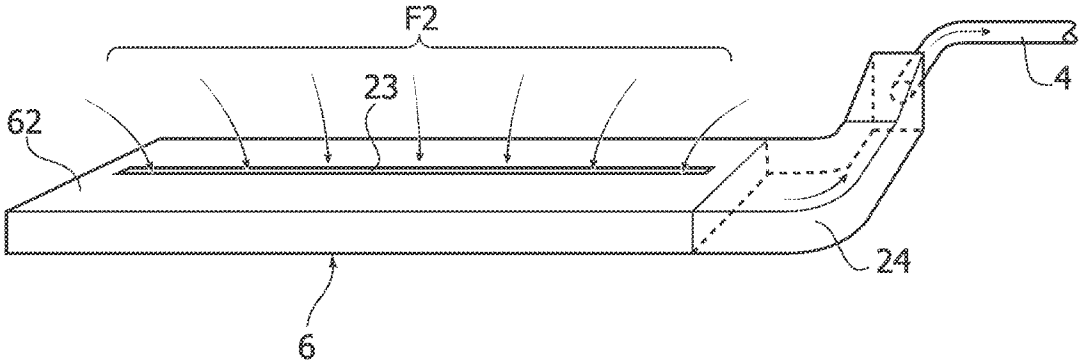
FIGS. 14-25B are schematic perspective views illustrating different embodiments of an intake terminal forming part of a personal air exchange system.

As illustrated in FIG. 14, in order to effectively carry out the intake of the airflow F2 exhaled by a person operating at the station P, the intake terminal 6 comprises at least one intake opening, for example, implemented in the form of a series of micro-holes or at least one slit 23.

In this description, wherever the term slit is indicated, an intake micro-slit is intended, which may be indifferently made straight or with a round or rounded shape, and positioned at any point of the plane, in any direction and of any length.

In one or more embodiments, as well as in the one illustrated in FIG. 14, the intake terminal 6 is a plate-shaped element with at least one air intake slit 23 arranged on a main face 62 of the terminal 6. In one or more embodiments, as well as in the one illustrated in FIG. 14, the intake terminal 6 defines a connecting micro-plenum 24 interposed between the end portion of one of the return channels 4 and the body of the intake terminal 6.

Figure 15:
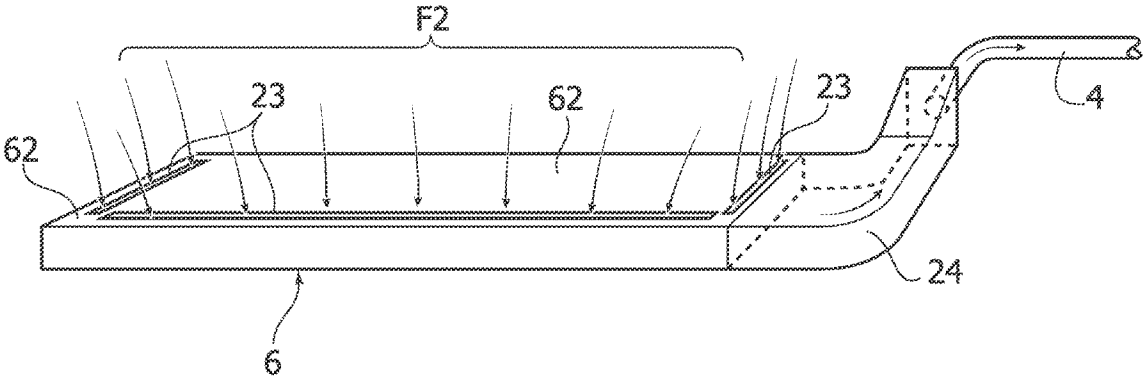

In one or more embodiments, as well as in the one illustrated in FIG. 15, the intake terminal 6 comprises a plurality of slits 23 arranged on several sides of the main face 62 of the terminal 6.

Figure 16:
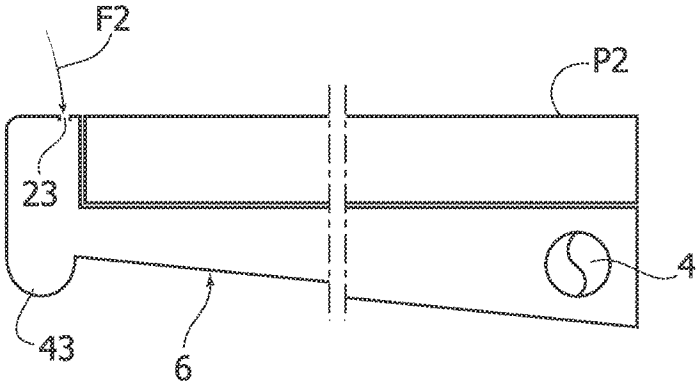

In one or more embodiments, as well as in the one illustrated in FIG. 16, the intake terminal 6 may be connected cantilevered with respect to the support surface P2 so as to extend along the end and below the support surface P2. The intake terminal 6 may have a slit 23 oriented along a vertical direction and perpendicular to the support surface P2. Again with reference to FIG. 16, it should, therefore, be noted that the terminal 6 defines an under-table element with an upper opening 23 flush with the support surface P2. In one or more embodiments, as well as in the one illustrated in FIG. 16, the intake terminal 6 comprises a seat 43 designed to collect any impurities that may be sucked from the support surface.

Of course, the intake terminal 6 comprises a connecting portion for connecting the terminal to the outlet of a respective return channel 4.

Figure 17:
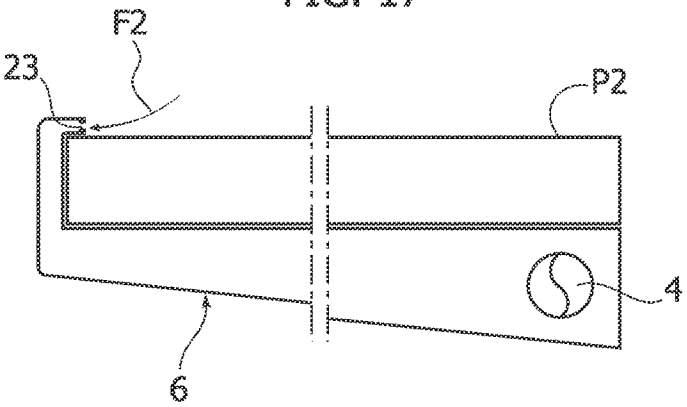

In one or more embodiments, as well as in the one illustrated in FIG. 17, the intake terminal 6 is made in a similar way to that previously indicated for FIG. 17. In this case, the terminal 6 comprises a slit 23 oriented along a horizontal direction and parallel to the plane P2, close to a front edge of the support surface P2.

Figure 18:
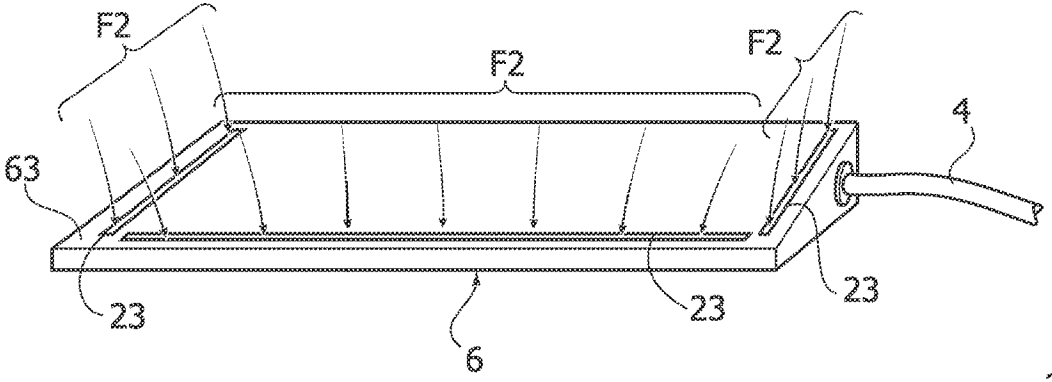

In one or more embodiments, as well as in the one illustrated in FIG. 18, the intake terminal 6 is a keyboard-rest device or laptop-support device P4, defining an inclined support surface 63. On the support surface 63, at one or more sides, one or more slits 23 are formed.

Figure 19:
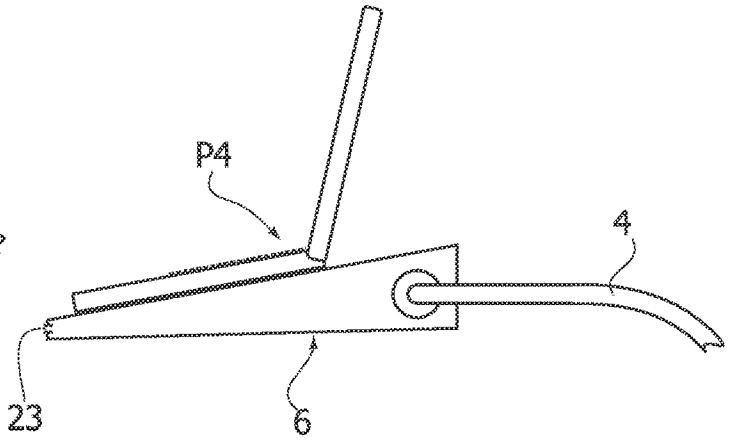

In one or more embodiments, as well as in the one illustrated in FIG. 19 wherein the terminal 6 supports a laptop device P4, the terminal 6 comprises a front slit 23 formed along a front side of the terminal 6.

Figure 20:
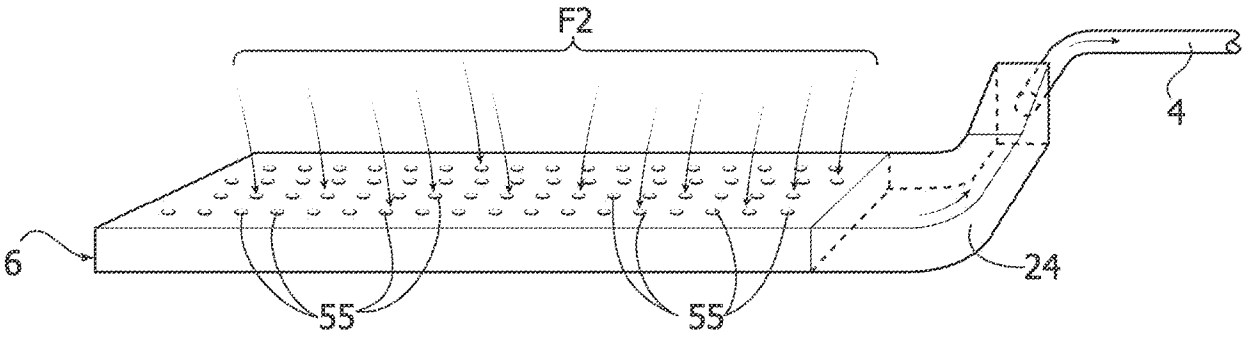

In one or more embodiments, as well as in the one illustrated in FIG. 20, the intake terminal 6 is a plate-shaped element on which a plurality of air intake holes 55 are formed.

Figure 21:
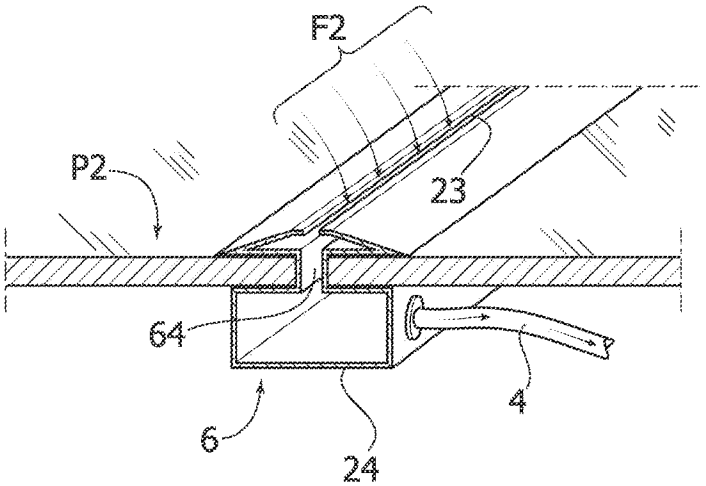

In one or more embodiments, as well as in the one illustrated in FIG. 21, the intake terminal 6 is a channel element, equipped with a micro-slit 23, which can be mounted on a support surface P2. This channel element comprises a passage channel 64 extending between the openings 23 and a lower face of the support surface P2. The terminal 6 also comprises a connecting plenum 24 spaced below the support surface 24, and connected to a return channel 4. Of course, the shape and number of openings 23 may vary widely from what is shown in FIG. 37.

Figure 22:
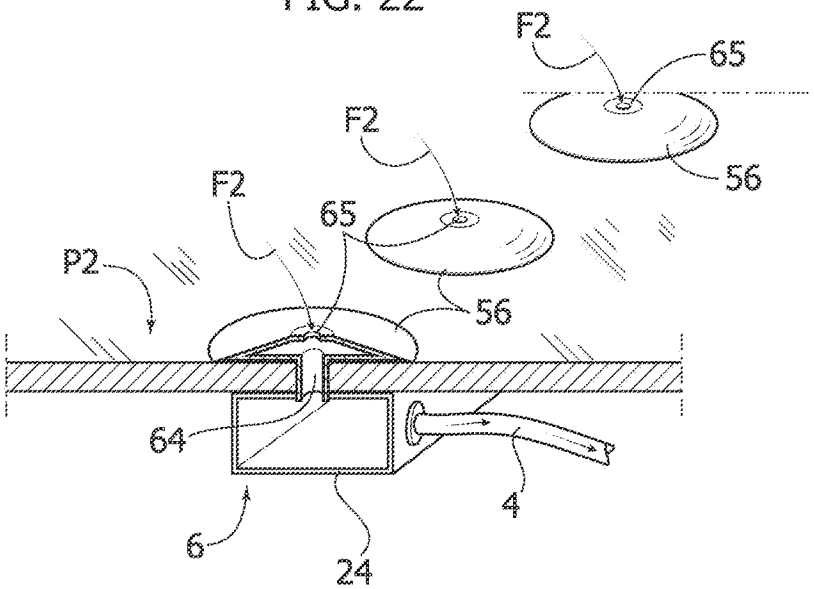

In one or more embodiments, as well as in the one illustrated in FIG. 22, the intake terminal 6 comprises the passage channel 64 and the connecting plenum 24 spaced in a similar way to what has already been described. In this case, a series of openings 56 connected to the channel 64 are arranged above the support surface P2. At the upper end of the mouths 56 there is a hole 65 for air intake.

Figure 23:
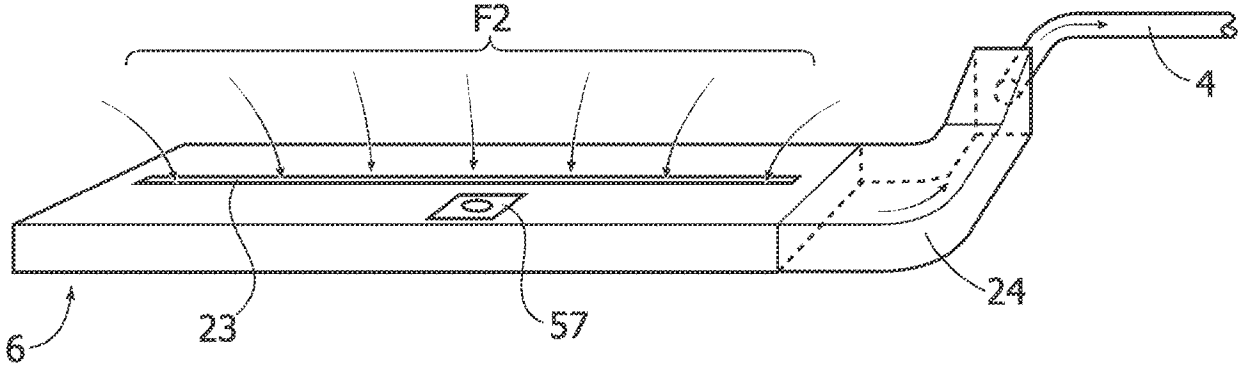

In one or more embodiments, as well as in the one illustrated in FIG. 23, the intake terminal 6 may comprise an infrared thermal sensor 57, which detects an exhalation phase of a person by reading the temperature at the outlet of the person's nostrils, so as to activate or modulate the intake in synchrony with the exhalation.

Figure 24:
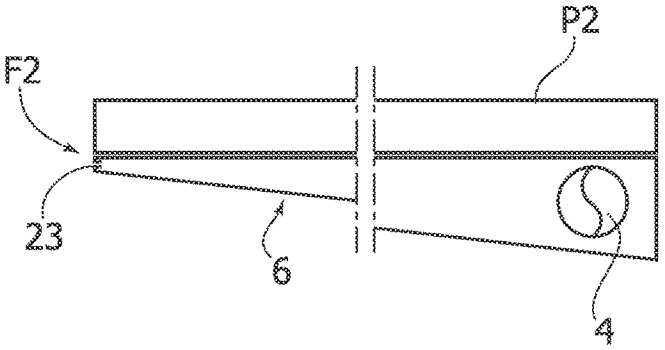

In one or more embodiments, as well as in the one illustrated in FIG. 24, the intake terminal 6 may be connected to the support surface P2 so as to extend below the support surface P2. The intake terminal 6 may present a slit 23 oriented along a horizontal direction and parallel to the plane P2, close to a front edge of the support surface P2.

Figure 25B:
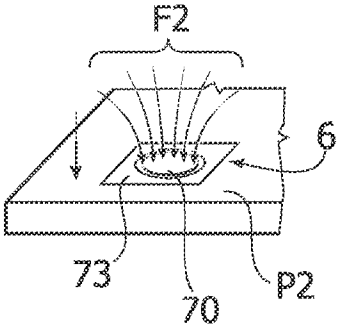
Figure 25A:
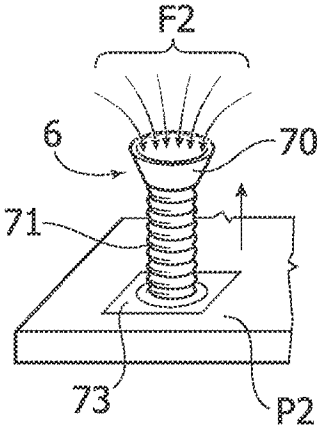

In one or more embodiments, as well as in the one illustrated in FIGS. 25A and 25B, the intake terminal 6 comprises a telescopic structure 71, which can be extracted from the support surface P2, designed to selectively create an extended configuration (FIG. 25A) and a retracted configuration (FIG. 25B). The return channel is included within the structure 71. At the end of the terminal 6 there is an intake mouth 70, preferably with a conical shape converging towards the structure 71. In the extended configuration, the terminal 6 extends along a substantially vertical direction from the support surface P2, in particular from a base portion 73. In the retracted configuration, the intake mouth 70 of the terminal 6 is flush with the support surface P2. In both configurations, the terminal 6 may be operative to perform the aforesaid intake function.

The intake terminals 6 as described above allow limiting the diffusion within the environment of the exhaled air and, consequently, of all the airborne volatile compounds it contains ($CO_2$, bacteria, viruses, water vapor, volatile organic compounds).

As previously indicated, all the aforesaid characteristics of the intake terminals 6 may be associated with one or more diffusion terminals 5 incorporating the unique characteristics of the invention.

As is evident from the above description, the diffusion terminal 5 according to the invention may be applied in any situation in which there is a seat or possibly a standing position, with or without a support surface P2.

As a result of the characteristics described above, the air diffusion terminal 5 and the corresponding air exchange system 1 allow a series of important advantages to be obtained:

- increasing the quality of the air breathed by a person who is stationed at a fixed station, ensuring a supply of clean air right at the inhalation area.
- creating a "deep throw" diffuser, or rather, a launch characterized by a predominantly laminar motion, and with very low mixing of the air emitted with respect to the ambient air, and which maintains these characteristics for a considerable distance;
- drastically reducing the flow of clean primary air generally introduced into the rooms, and consequently reducing the energy consumption for the treatment and pumping of the air itself. Investigations conducted by the Applicant have shown that this flow rate may drop below 10 $m^3$/h, reducing by 75% the installation and management costs of traditional ventilation systems based on an airflow rate legally established, for example, 39.6 $m^3$/h for office environments;
- obtaining a high reduction in energy consumption; and
- improving coexistence in medium- or high-crowded environments with a reduction in the risk of infection by viruses/bacteria.

Of course, without prejudice to the principle of the invention, the details of construction and the embodiments may vary widely with respect to those described and illustrated purely by way of example, without departing from the scope of protection of the present invention, as defined by the attached claims.

The invention claimed is:

1. A diffusion terminal of clean air, provided for improving the quality of the air breathed by a person, said diffusion terminal comprising:

an outer body, which is configured to be connected to an outlet of a respective supply channel of clean air, said outer body-having an outlet mouth provided for supplying clean air towards an inhalation area of a person, a first conical element at least partially hollow arranged inside the outer body, in such a way that an axis of the first conical element is substantially coincident with a main axis of the body, said first conical element having a base portion arranged close to a plane defined by the outlet mouth of the outer body, so as to provide an outlet of an airflow along a crown defined between an inner surface of the outer body and an outer surface of the first conical element, said first conical element comprises at least one opening to enable passing of an airflow within the first conical element and through an outlet mouth of the first conical element, in such a way that the clean air supplied by means of the diffusion terminal is realized with an airflow passing through said crown and another central airflow passing through the first conical element, wherein said first conical element is tapered proceeding away from the outlet mouth of the outer body, creating a cavity with a shape converging towards the outlet mouth of the outer body, defined by the inner surface of the outer body and by the outer surface of the first conical element, in such a way that the air emitted by said crown, before leaving the crown, crosses a cavity with a shape converging towards the outlet along the crown.

2. A diffusion terminal according to claim 1, wherein said diffusion terminal comprises a separation element provided with a plurality of openings, and arranged within the first conical element.

3. A diffusion terminal according to claim 1, wherein the outer surface of said first conical element presents a plurality of raised elements formed as a series of striations or fins or ribs with a shape of a helical thread, so as to confer to the airflow supplied by the crown a substantially tubular shape with rotational motion around the axis of the first conical element, in order to protect the central airflow.

4. A diffusion terminal according to claim 1, comprising a plurality of fins protruding radially from an upper portion of the first conical element, arranged for connection to the inner surface of the outer body.

5. A diffusion terminal according to claim 1, wherein said diffusion terminal comprises at least one deflector member arranged within said first conical element and provided in order to adjust a flow rate of the airflow passing through said outlet mouth of the first conical element.

6. A diffusion terminal according to claim 1, wherein said diffusion terminal is associated with at least one regulating device provided for regulating an intensity and/or a temperature of the airflow flowing from the diffusion terminal.

7. A diffusion terminal according to claim 1, wherein said diffusion terminal can be installed in a ceiling or in a wall, so that said outlet mouth of the outer body is flush with a ceiling or wall plane, or protrudes from said plane.

8. A diffusion terminal according to claim 1, wherein said diffusion terminal is supported by means of a support structure, provided for being rigidly connected to a support surface or freely supported on a support surface or rigidly connected to other elements resting on said support surface of a station, in such a way that said diffusion terminal results in a raised position above the support surface, said support structure-comprising adjustable elements, arranged to adjust the position of the diffusion terminal and consequently the direction of the airflow introduced by said diffusion terminal.

9. A diffusion terminal according to claim 1, wherein said diffusion terminal comprises one or more lighting devices integrated with said diffusion terminal.

10. A diffusion terminal according to claim 1, comprising a second conical element arranged within a cavity defined by the first conical element, so that the axis of the second conical element coincides with the axis of the first conical element, said second conical element having an opening to allow the passage of a flow of air through an outlet mouth-of the second conical element.

11. A personal air exchange system, which can be integrated into a building, configured to improve the quality of the air breathed at one or more stations in the building, wherein a person may be stationed for any type of need, said personal air exchange system comprising:

a capillary distribution network including at least one supply channel for supplying clean air, the at least one diffusion terminal according to claim 1, connected to a respective supply channel, said personal air exchange system also comprising a main supply network of clean air, which can be taken from outside the building, connected to at least one supply channel.

12. A system according to claim 11, wherein said system comprises an electronic control unit arranged to control an introduction of an airflow with a non-constant flow rate.

13. A system according to claim 11, wherein said system comprises an essential oil vaporization device, arranged to diffuse a fragrance into the environment.

14. A system according to claim 11, wherein said capillary distribution network comprises at least one return channel of stale air, said system further comprising at least one intake terminal for a flow of stale air-connected to an outlet of the respective return channel, said at least one intake terminal being placeable at one or more stations, said personal air exchange system also comprising a main return network of stale air, connected to the at least one return channel, and configured for providing a final expulsion of the stale air outside the building, in such a way that said personal air exchange system is configured to limit the diffusion of the air exhaled by one or more persons.

15. A system according to claim 14, wherein said at least one intake terminal has at least one opening for intake of stale air.

* * * * *